US008584269B2

(12) United States Patent
Jin et al.

(10) Patent No.: US 8,584,269 B2
(45) Date of Patent: Nov. 19, 2013

(54) NOZZLE ASSEMBLY OF TOILET BIDET AND CONTROL METHOD THEREOF

(75) Inventors: Sung-Worl Jin, Seoul (KR); Jae-Young Jho, Seoul (KR); Yong-Hyup Kim, Seoul (KR); Seung-Heon Lee, Seoul (KR)

(73) Assignee: Woongjin Coway Co., Ltd., Yougu-Eup, Gongjoo, Choongcheongnam-Do (KR)

( * ) Notice: Subject to any disclaimer, the term of this patent is extended or adjusted under 35 U.S.C. 154(b) by 356 days.

(21) Appl. No.: 13/122,677

(22) PCT Filed: Sep. 30, 2009

(86) PCT No.: PCT/KR2009/005606

§ 371 (c)(1),
(2), (4) Date: Apr. 5, 2011

(87) PCT Pub. No.: WO2010/041844

PCT Pub. Date: Apr. 15, 2010

(65) Prior Publication Data

US 2011/0203043 A1 Aug. 25, 2011

(30) Foreign Application Priority Data

Oct. 7, 2008 (KR) ..... 10-2008-0098271

(51) Int. Cl.
*A47K 4/00* (2006.01)

(52) U.S. Cl.
USPC ..... 4/420.4

(58) Field of Classification Search
USPC ..... 4/420.4, 420–448
See application file for complete search history.

(56) References Cited

U.S. PATENT DOCUMENTS 5,874,568 A 2/1999 Iwai

FOREIGN PATENT DOCUMENTS

| | | | | |
|---|---|---|---|---|
| CN | 1153849 | A | | 7/1997 |
| JP | 2001-196222 | A | | 7/2001 |
| JP | 2003-506858 | A | | 2/2003 |
| JP | 2003-275627 | | | 3/2003 |
| JP | 2003-275627 | | | 9/2003 |
| JP | 2003275627 | A | * | 9/2003 |
| JP | 2005-118761 | | | 5/2005 |
| JP | 2005118761 | A | * | 5/2005 |
| JP | 2007-054737 | | | 3/2007 |
| JP | 3922059 | B2 | | 3/2007 |
| JP | 2007054737 | A | * | 3/2007 |
| KR | 10-0525837 | | | 11/2005 |
| KR | 100525837 | B1 | * | 11/2005 |
| WO | 01/06579 | A2 | | 1/2001 |

OTHER PUBLICATIONS

PCT Search Report for PCT/KR2009/005606, dated May 26, 2010.

* cited by examiner

*Primary Examiner* — Lori Baker
(74) *Attorney, Agent, or Firm* — Dority & Manning, P.A.

(57) ABSTRACT

A nozzle assembly of a toilet bidet and its control method are disclosed. The nozzle assembly includes: a cleansing nozzle with a cleansing water flow path; a dispensing tube connected with the cleansing water flow path to dispense cleansing water; an actuator including a connector coupled to the dispensing tube and a plurality of polymer driving bodies coupled to the connector, wherein an electroactive polymer is housed within the polymer driving bodies, a pair of electrodes are formed on an outer surface of the polymer driving bodies, and when voltage is selectively applied to the electrodes of each polymer driving body, the electroactive polymer moves toward one electrode to force a corresponding polymer driving body to be bent to thereby adjust a dispensing angle of the dispensing tube; and a voltage supply unit that applies voltage to the electrode of the polymer driving body.

18 Claims, 6 Drawing Sheets

NOZZLE ASSEMBLY OF TOILET BIDET AND CONTROL METHOD THEREOF

TECHNICAL FIELD

The present invention relates to a nozzle assembly of a toilet bidet and a control method thereof.

BACKGROUND ART

In general, a toilet (i.e., a toilet bowl, a chamber pot, etc.) is equipment allowing a user to be seated to pass a bowl movement. The toilet may be equipped with a bidet to make a restroom convenient and for a sanitary purpose.

A nozzle assembly is installed to dispense water to cleanse the private parts of a user after the user relieves himself. The nozzle assembly includes a nozzle that makes a forward movement and then dispenses cleansing water. In detail, when the user presses a cleansing button, the nozzle makes a forward movement from the nozzle assembly and dispenses cleansing water to the private parts of the user. When cleansing is completed, the nozzle is retracted to be returned to its original position.

In order to remove foreign materials such as feces from a surface of the nozzle, a nozzle cleansing apparatus is installed. The nozzle cleansing apparatus dispenses cleansing water to the surface of the nozzle when the nozzle returns to its original position.

However, in the related art toilet bidet, the nozzle is installed to advance and retreat only in a forward/backward direction, so it is difficult to variably control the nozzle at its dispensing positions or/and angles.

DISCLOSURE OF INVENTION

Technical Problem

An aspect of the present invention provides a nozzle assembly of a toilet bidet capable of variably controlling a cleansing nozzle at cleansing water dispensing positions or/and angles, and a control method thereof.

Another aspect of the present invention provides a nozzle assembly of a toilet bidet capable of enabling a water stream of a cleansing nozzle to vibrate or rotate, and its control method.

Solution to Problem

According to an aspect of the present invention, there is provided a nozzle assembly of a toilet bidet including: a cleansing nozzle with a cleansing water flow path; a dispensing tube connected with the cleansing water flow path to dispense cleansing water; an actuator including a connector coupled to the dispensing tube and a plurality of polymer driving bodies coupled to the connector, wherein an electroactive polymer is housed within the polymer driving bodies, a pair of electrodes are formed on an outer surface of the polymer driving bodies, and when voltage is selectively applied to the electrodes of each polymer driving body, the electroactive polymer moves toward one electrode to force a corresponding polymer driving body to be bent to thereby adjust a dispensing angle of the dispensing tube; and a voltage supply unit that applies voltage to the electrodes of the polymer driving bodies.

The plurality of polymer driving bodies may be disposed such that pairs of the polymer driving bodies face each other centered on the dispensing tube.

Two pairs of polymer driving bodies may be disposed, of which one pair is disposed along a lengthwise direction of the nozzle body and the other pair is disposed at both sides of the nozzle body in the lengthwise direction.

The same polarity of voltage may be applied to the electrodes in the same direction in each of the pairs of polymer driving bodies.

A plurality of insertion portions may be formed at the connector to allow an end portion of each polymer driving body to be inserted therein.

Each insertion portion may be formed to have a gap with a corresponding polymer driving body in a direction perpendicular to a strain direction of the corresponding polymer driving body.

The voltage supply unit may include: an inner ring having a plurality of recesses on its external surface; an outer ring having an inner side to which the inner ring is inserted and having a plurality of recesses corresponding to the plurality of recesses of the inner ring to allow each polymer driving body to be inserted therein; and a printed circuit board that applies voltage to the electrode of each polymer driving body.

An electricity connection unit may be formed to correspond to the electrodes of each polymer driving body at the recesses of the inner ring and the outer ring.

The dispensing tube may be adjusted at a slope angle ranging from 0.5 degrees to 4 degrees.

According to another aspect of the present invention, there is provided a nozzle assembly of a toilet bidet including: a cleansing nozzle with a cleansing water flow path; a dispensing tube connected with the cleansing water flow path to dispense cleansing water; an actuator including a polymer stacked body to which a dispensing tube is coupled, and a pair or more electrodes formed on an outer surface of the polymer stacked body, wherein when voltage is selectively applied to the electrodes, electroactive polymer is moved toward one electrode to force the polymer stacked body to be bent to thus adjust a dispensing angle of the dispensing tube; and a voltage supply unit that applies voltage to the electrodes.

The respective pairs of electrodes may be disposed to face each other based on the dispensing tube.

Two pairs of electrodes may be disposed on the outer surface of the polymer stacked body, of which one pair of electrode is disposed along a lengthwise direction of the nozzle body, and the other pair of electrodes are disposed at both sides of the nozzle body in the lengthwise direction.

The voltage supply unit may include a printed circuit board applying voltage to each electrode.

A slope angle of the dispensing tube may be adjusted within the range of 0.5 degrees to 4 degrees.

According to another aspect of the present invention, there is provided a method for controlling a nozzle assembly of a toilet bidet, the method comprising: adjusting a dispensing angle of a dispensing tube by applying voltage to an electrode of a pair of facing polymer driving bodies among a plurality of polymer driving bodies.

According to another aspect of the present invention, there is provided a method for controlling a nozzle assembly of a toilet bidet, the method comprising: adjusting a dispensing angle of a dispensing tube by applying voltage to a pair of facing electrodes of a polymer stacked body.

According to another aspect of the present invention, there is provided a method for controlling a nozzle assembly of a toilet bidet, the method comprising: repeatedly applying voltage to the electrodes of polymer driving bodies and cutting it off, to continuously change a dispensing angle of a dispensing tube to thus allow a water stream to be dispensed while being vibrated or rotated.

Immediately when the voltage applied to the pair of electrodes is cut off, the voltage may be applied to another pair of electrodes.

Advantageous Effects of Invention

According to exemplary embodiments of the invention, a water dispensing position and/or water dispensing angle of a cleansing nozzle can be variably adjusted.

Also, a water stream of the cleansing nozzle can be formed to be vibrated or rotated.

BEST MODE FOR CARRYING OUT THE INVENTION

A toilet bidet according to an exemplary embodiment of the present invention will now be described.

Figure 1:
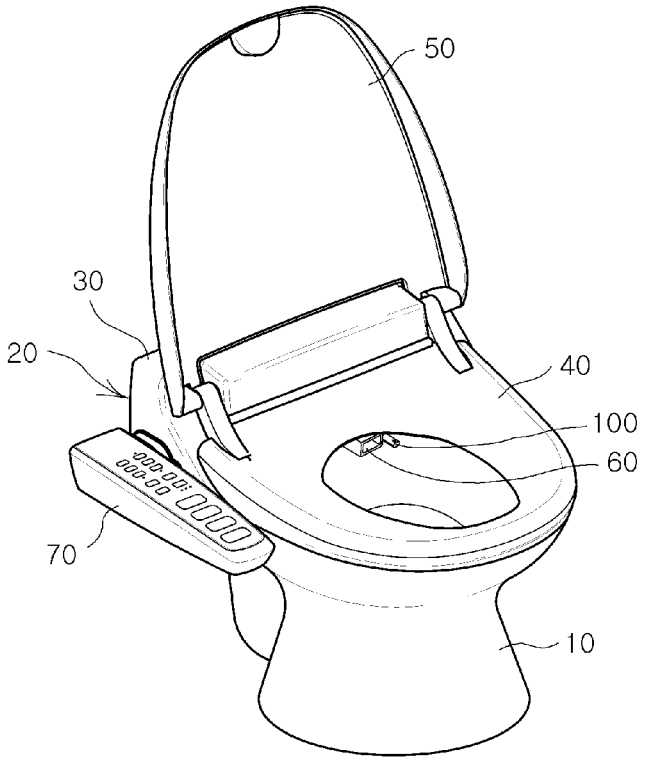
FIG. 1 is a perspective view of a toilet bowl and a toilet bidet according to an exemplary embodiment of the present invention.

FIG. 1 is a perspective view of a toilet bowl and a toilet bidet according to an exemplary embodiment of the present invention.

With reference to FIG. 1, a toilet bowl 10 accommodates water. A toilet bidet 20 is installed at an upper portion of the toilet bowl 10.

The toilet bidet 20 includes a main body 30 mounted on the toilet bowl 10. A bracket (not shown) may be disposed at a lower side of the main body 30 such that it is mounted at a rear side of an upper surface of the toilet bowl 10.

A seat plate 40 is rotatably coupled at a front side of the main body 30. A heater (not shown) is disposed within the seat plate 40 to heat the seat plate 40 to a proper temperature.

A cover 50 is rotatably coupled at an upper side of the main body 30. The cover 50 is hinge-coupled at the upper side of the main body 30 so as to cover the seat plate 40 and the upper portion of the toilet bowl 10.

A drying device 60 may be installed at an inner side of the main body 30. The drying device 60 may blow air of room temperature or air of high temperature to parts of the user's body.

A nozzle assembly 100 is disposed at the inner side of the main body 30 such that is can be reciprocally moved forward and backward. The nozzle assembly 100 includes a nozzle through which cleansing water is dispensed.

A control panel 70 may be disposed at one side of the main body 30 to control the drying device 60 and the nozzle assembly 100. The control panel 70 includes a plurality of buttons to allow the user to select a certain function. When the user presses a cleansing button, the nozzle 110 moves forward and dispenses cleansing water to cleanse the user's private parts.

Figure 2:
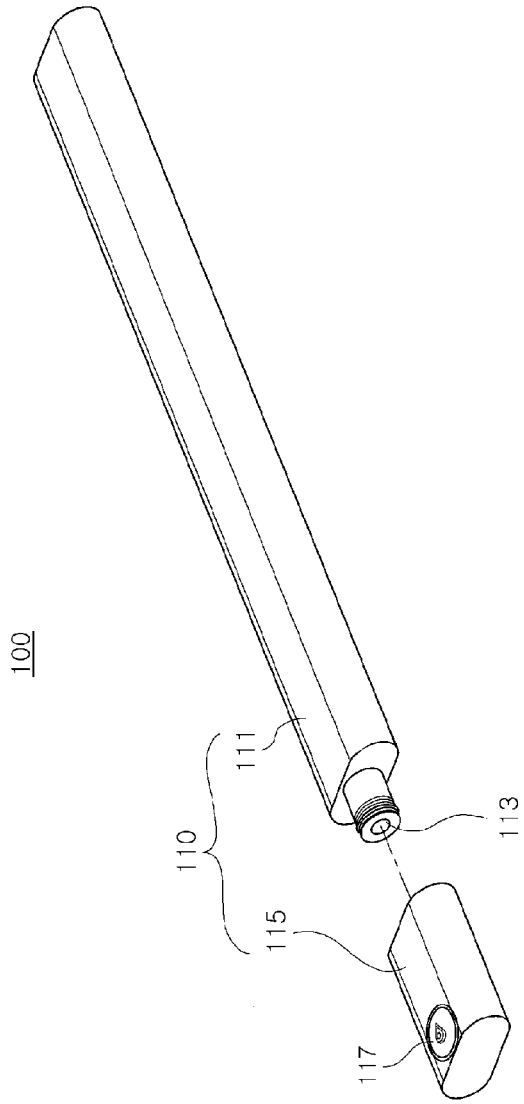
FIG. 2 is a perspective view of a nozzle assembly of the toilet bidet of FIG. 1.
Figure 3:
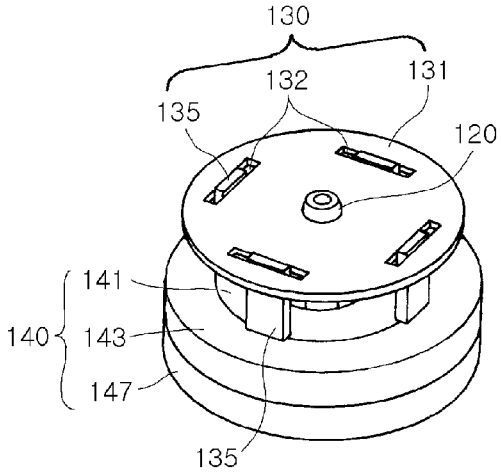
FIG. 3 is a perspective view showing a first example of an actuator constituting the nozzle assembly of FIG. 2.
Figure 4:
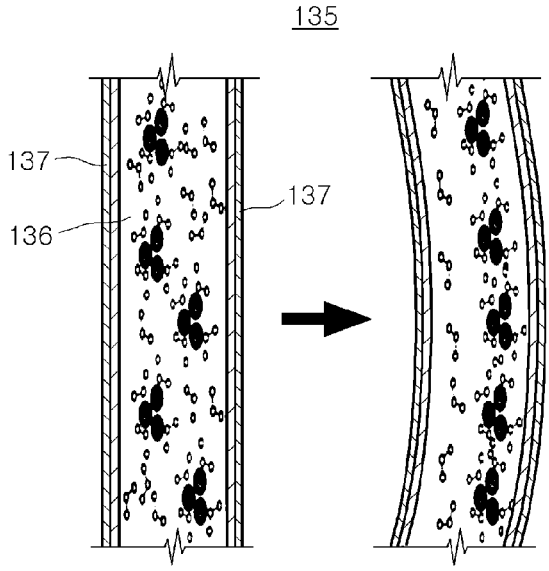
FIG. 4 is a sectional view of a polymer driving body constituting the actuator of FIG. 3.

FIG. 2 is a perspective view of a nozzle assembly of the toilet bidet of FIG. 1, FIG. 3 is a perspective view showing a first example of an actuator constituting the nozzle assembly, and FIG. 4 is a sectional view of a polymer driving body constituting the actuator of FIG. 3.

With reference to FIGS. 2 to 4, the nozzle assembly 100 of the toilet bidet includes a cleansing nozzle 110, a dispensing tube 120 (See FIG. 3), an actuator 130, and a voltage supply unit 140.

The cleansing nozzle 110 includes a nozzle body 111 including a cleansing water flow path 113 formed along a lengthwise direction, and a nozzle tip 115 detachably coupled with an end portion of the nozzle body 111. The cleansing nozzle 110 is installed to be protracted or retracted by a motor (not shown) and a gear part (not shown).

A nozzle cover 117 is disposed to form an upper surface of the nozzle tip 115. The nozzle cover 117 may be formed in a substantially disk shape.

A dispensing tube 120 (See FIG. 3), an actuator 130, and a voltage supply unit 140 may be disposed at a lower side of the nozzle cover 117.

The dispensing tube 120 (See FIG. 3), which is connected with the cleansing water flow path 113 of the cleansing nozzle 110 to dispense cleansing water, is coupled with the nozzle tip 115. The dispensing tube 120 may have a thin, long tube shape. The dispensing tube 120 may be made of a flexible material.

The actuator 130 includes a connector 131 to which the dispensing tube 120 is coupled, and a plurality of polymer driving bodies 135 accommodating an electroactive polymer therein.

The connector 131 may have a circular disk shape or a polygonal plate shape. The connector 131 may be made of a hard polymer material.

The electroactive polymer includes an ionic polymer, a polymer gel, a conductive polymer, a carbon nanotube (CNT), and the like. When positive (+) voltage and negative (−) voltage are applied, the electroactive polymer moves to one electrode 137. Hereinafter, the ionic polymer will be described.

The ionic polymer includes a perfluorosulfonic acid polymer and the like. The perfluorosulfonic acid polymer refers to a sulfonic acid in which hydrogen is replaced with fluorine. The perfluorosulfonic acid polymer assumes the positive polarity (+).

The perfluorosulfonic acid polymer has the following chemical formula:

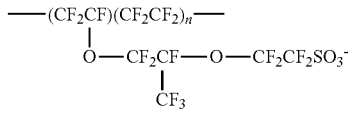

The ionic polymer can have a great strain when a low voltage of about 3 volt to 8 volt is applied thereto. Thus, because the ionic polymer moves to one electrode 137 when a low voltage is applied thereto, the possibility of electric shocks can be removed.

In addition, the ionic polymer has free radicals present at an amount of approximately 0.9 meq./g, a water content of approximately 25 wt %, and an ion conductivity of approximately 0.1 S/cm. Thus, the ionic polymer has film characteristics that can sufficiently compensate electrochemical characteristics in fabricating the polymer driving bodies 135.

In addition, Young's modulus of a hydrated film of the ionic polymer is approximately 85 MPa. Thus, the ionic polymer has such a suitable mechanical flexibility as to be used as the polymer driving body 135.

Meanwhile, the plurality of polymer driving bodies 135 may be disposed at the connector 131 such that they surround the dispensing tube 120. In this case, the connector 131 may include insertion portions 132 to which end portions of the polymer driving bodies 135 can be inserted. The insertion portions 132 may be insertion recesses or insertion holes.

Each polymer driving body 135 may include a polymer stacked body 136 formed by stacking a plurality of polymer films 136*a*, and a pair of electrodes 137 disposed at both sides of the polymer stacked body 136. The electroactive polymer such as the ionic polymer is accommodated within the polymer film 136*a*.

Mutually opposing voltages are applied to the one pair of electrodes 137 of each polymer driving body 135. In this case, as the hydrated electroactive polymer moves toward one electrode 137, the polymer driving body 135 is bent to one side. Then, the connector 131 is moved to one side, and accordingly, a dispensing angle of the dispensing tube 120 is adjusted.

The plurality of polymer driving bodies 135 may be disposed by making pairs such that respective pairs face each other based on the dispensing tube 120.

For example, two pairs of polymer driving bodies 135 may be disposed. In this case, one pair of polymer driving bodies 135 may be disposed to be parallel to a lengthwise direction of the nozzle body 111, and the other pair of polymer driving bodies 135 may be disposed to be perpendicular to the lengthwise direction at both sides of the nozzle body 111 in the lengthwise direction. In addition, the connector 131 includes the insertion portions 132 at every 90-degree intervals in order to allow the end portions of the polymer driving bodies 135 to be inserted therein.

In the one pair of polymer driving bodies 135, voltages of the same polarity are applied to the electrodes 137 in the same direction. For example, in the one pair of polymer driving bodies 135, a positive (+) voltage is applied to left electrodes 137, and a negative (−) voltage is applied to right electrodes 137.

At this time, because the hydrated electroactive polymer of the one pair of polymer driving bodies 135 moves to the right electrode 137 to which the negative (−) voltage is applied, the right electrode 137 expands and the left electrode 137 contracts in the one pair of the polymer driving bodies 135. Accordingly, the one pair of polymer driving bodies 135 are bent toward the left electrode 137, forcing the connector 131 to be slightly moved to the left. Then, the dispensing tube 120 is slightly sloped to the left according to the movement of the connector 131.

In addition, if two pairs of polymer driving bodies 135 are disposed, one pair of the polymer driving bodies 135 may be disposed such that they are not parallel to the lengthwise direction of the nozzle body 111, while the other pair of polymer driving bodies 135 may be disposed such that they are not perpendicular to the lengthwise direction of the nozzle body 111.

In addition, three or more pairs of polymer driving bodies 135 may be disposed. In this case, the respective pairs of polymer driving bodies 135 may be disposed to face each other.

With the polymer driving bodies 135, the dispensing tube 120 may be adjusted to be sloped at a slope angle ranging from 0.5 degrees to 4 degrees. In this case, the slope angle of the dispensing tube 120 may be appropriately adjusted by controlling the size of voltage applied to the polymer driving bodies 135.

Namely, if a voltage of 3V is applied to the polymer driving bodies 135, the amount of hydrated electroactive polymer moving to one electrode 137 of the electroactive polymer decreases relatively. Then, the polymer driving bodies 135 are relatively less bent, so the slope angle of the dispensing tube 120 is relatively small.

If a voltage of 8V is applied to the polymer driving bodies 135, the amount of hydrated electroactive polymer moving to one electrode 137 of the electroactive polymer increases relatively. Then, the polymer driving bodes 135 are relatively more bent, so the slope angle of the dispensing tube 120 is relatively large.

As the distance between the nozzle tip 115 and the private parts increases, the slope angle of the dispensing tube 120 is adjusted to be close to 0.5 degrees, while the distance decreases, the slope angle is adjusted to be close to 4 degrees. This is because, as the dispensing distance is long, a change in the arrival position is relatively large although the dispensing angle is small, and as the dispensing distance is short, the change in the arrival position is relatively small although the dispensing angle is large.

The insertion portions 132 may be formed to have a gap with each corresponding polymer driving body 135 in a direction perpendicular to the strain direction of each corresponding polymer driving body 135. Namely, the insertion portions 132 to which the one pair of left and right polymer driving bodies 135 are inserted have a forward/backward directional gap, and the insertion portions 132 to which the one pair of front and rear polymer driving bodies 135 are inserted have a left/right directional gap.

As voltage is applied to the two pairs of polymer driving bodies 135 and repeatedly cut it off, the connector 131 can be rotated. In this case, because each polymer driving body 135 has the slight gap in each corresponding insertion portion 132, the connector 131 can be smoothly rotated. This will be described in detail later at an operation part of the present invention.

Figure 5:
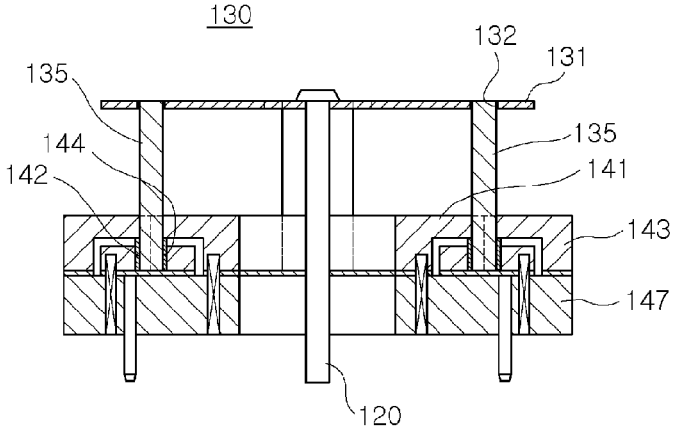
FIG. 5 is a sectional view of the actuator of FIG. 3.
Figure 6:
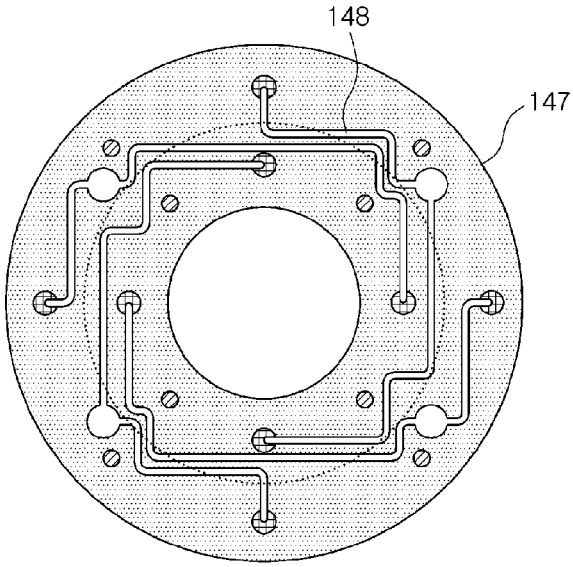
FIG. 6 is a sectional view of a printed circuit board of a voltage supply unit of FIG. 3.

FIG. 5 is a sectional view of the actuator of FIG. 3, and FIG. 6 is a sectional view of a printed circuit board (PCB) of the voltage supply unit of FIG. 3.

With reference to FIGS. 5 and 6, the power supply unit 140 includes an inner ring 141, an outer ring 143 inserted to an outer side of the inner ring 141, and a PCB 147 applying voltage to the electrode 137 of each polymer driving body 135.

A plurality of recesses are formed on an outer circumferential surface of the inner ring 141, and a plurality of recesses are formed on an inner circumferential surface of the outer ring 143 such that they correspond to the plurality of recesses formed on the inner ring 141. The polymer driving bodies 135 are inserted into the recesses of the inner ring 141 and the outer ring, respectively.

Electric connection regions 142 and 144 may be formed at the recesses of the inner ring 141 and the outer ring 143 such that they correspond to the electrodes 137 of each polymer driving body 135. In addition, a wiring 148 may be printed in the PCB 147 so as to be connected with the electric connection regions 142 and 144.

A method for fabricating the polymer driving body configured as described above according to an exemplary embodiment of the present invention will now be explained.

Figure 7:
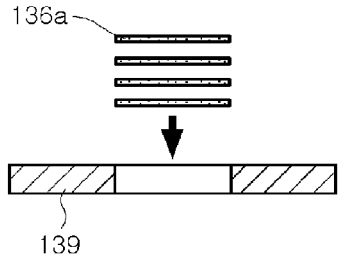
FIGS. 7 and 8 are sectional views showing the process of fabricating the polymer driving body of FIG. 3.
Figure 8:
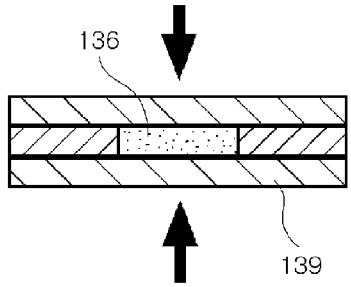

FIGS. 7 and 8 are sectional views showing the process of fabricating the polymer driving body of FIG. 3.

With reference to FIGS. 7 and 8, a space is formed within a mold 139, and a plurality of polymer films 136*a* are stacked in the space of the mold 139. In this case, the number of stacked polymer films 136*a* may be consciously designed in consideration of a mechanical bending stiffness and a driving force.

When the plurality of polymer films 136*a* are stacked in the mold 139, upper and lower sides of the polymer films 136*a* are heated to be compressed to fabricate a polymer stacked body 136 having a certain thickness.

The metal electrodes 137 are deposited on both sides of the polymer stacked body 136. As the deposition method of the metal electrodes 137, an impregnation chemical reduction called chemical reduction (or electroless plating) is used.

A chemical formula of the impregnation chemical reduction is shown below:

$$NaBH_4+4[Pt(NH_3)_4]^{2+}+8OH^- \rightarrow 4Pt^0+16NH_3+Na^++BO_2^-+6H_2O$$

In the reduction, $[Pt(NH_3)_4]Cl_2$ is used as platinum ion and $NaBH_4$ is used as a reducing agent.

The platinum electrode 137 with a thickness of a few mm is deposited on the surface of the polymer film by using the above chemical reaction. The plating reaction is repeated several times to obtain the metal electrode 137 deposited with a proper thickness to have a suitable electrical conductivity to be used.

The metal electrode 137 may be deposited on the surface of the polymer film through various deposition methods other than the above-described deposition method.

The operation of the nozzle assembly configured as described above will now be explained.

Figure 9:
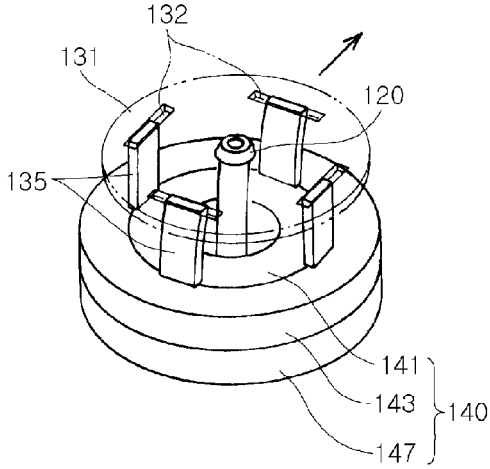
FIG. 9 is a perspective view showing a state that a dispensing tube of FIG. 3 is inclined rightward.
Figure 10:
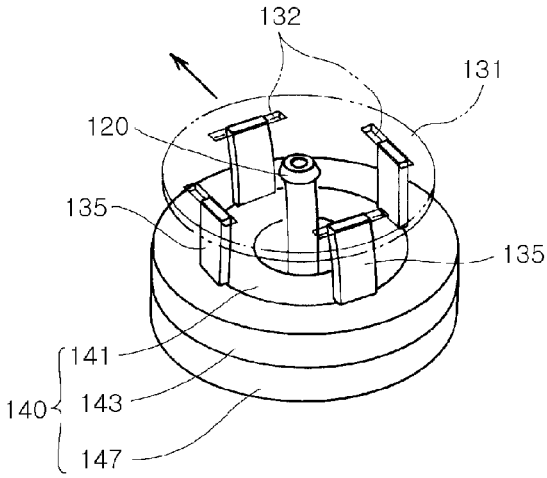
FIG. 10 is a perspective view showing a state that the dispensing tube of FIG. 3 is inclined forward.

In describing the operation of the nozzle assembly, it is defined that a right side is in a direction of the arrow in FIG. 9, a left side is in the opposite direction to the arrow in FIG. 9, a front side is in a direction of the arrow in FIG. 10, and a rear side is in the opposite direction to the arrow in FIG. 10.

When a voltage is applied to the electroactive polymer, the electroactive polymer is heated to evaporate moisture. Then, ions within the electroactive polymer cannot move due to the shortage of moisture, making the electroactive polymer unable to operate.

In this respect, however, because the polymer driving bodies 135 are disposed at the inner side of the nozzle tip 115, moisture is continuously supplied to the electroactive polymer of each polymer driving body 135 through the cleansing water flow path 113. Thus, moisture can be supplied in sufficient amount to the polymer driving bodies 135.

The dispensing tube 120 can be inclined forward/backward or left/right, or rotated by selectively supplying power to the electrodes 137 of the polymer driving bodies 135.

The dispensing tube 120 of the nozzle assembly 100 can be controlled to be inclined or rotated through the control panel 70.

First, the case where the dispensing tube 120 is inclined to the left and right side will now be described.

FIG. 9 is a perspective view showing a state in which the dispensing tube of FIG. 3 is inclined rightward.

With reference to FIG. 9, in the pair of left and right polymer driving bodies 135, a negative (−) voltage is applied to the left electrode 137, and the positive (+) voltage is applied to the right electrode 137.

At this time, because the hydrated electroactive polymer of the one pair of left and right polymer driving bodies 135 moves to the left electrode 137 to which the negative (−) voltage is applied, the left electrode 137 expands and the right electrode 137 contracts in the one pair of left and right polymer driving bodies 135. Accordingly, the one pair of left and right polymer driving bodies 135 are bent toward the right electrode 137, forcing the connector 131 to be slightly moved to the right (in the direction of the arrow in FIG. 9).

In addition, when the connector 131 is moved to the right, the connector 131 is not interfered with by the one pair of front and rear polymer driving bodies 135 due to the gap of the insertion portions 132.

Accordingly, the dispensing tube 120 of the nozzle assembly 100 dispenses cleansing water in a state of being inclined to the right by the connector 131, so an arrival position of the cleansing water is slightly moved to the right.

When the positive (+) voltage is applied to the left electrode 137 and the negative (−) voltage is applied to the right electrode 137 in one pair of the left and right polymer driving bodies 135, the one pair of left and right polymer driving bodies 135 are inclined to the left (in the opposite direction to the arrow in FIG. 9).

Accordingly, the dispensing tube 120 of the nozzle assembly dispenses cleansing water in a state of being inclined to the left, an arrival position of the cleansing water is slightly moved to the left.

When the position of the dispensing tube 120 is move in the left/right directions, no voltage is applied to the electrodes 137 of the one pair of front and rear polymer driving bodies 135.

Next, the case where the dispensing tube 120 is inclined to the front and rear side will now be described.

FIG. 10 is a perspective view showing a state in which the dispensing tube of FIG. 3 is inclined forward.

With reference to FIG. 10, in the pair of front and rear polymer driving bodies 135, a negative (−) voltage is applied to the rear electrode 137, and the positive (+) voltage is applied to the front electrode 137. At this time, because the hydrated electroactive polymer of the one pair of front and rear polymer driving bodies 135 moves to the rear electrode 137 to which the negative (−) voltage is applied, the rear electrode 137 expands and the front electrode 137 contracts in the one pair of left and right polymer driving bodies 135. Accordingly, the one pair of front and rear polymer driving bodies 135 are bent toward the front electrode 137, forcing the connector 131 to be slightly moved to the front side (the direction of the arrow in FIG. 10).

When the connector 131 is moved to the front side, the connector 131 is not interfered with by the one pair of left and right polymer driving bodies 135 because of the gap of the insertion units 132.

Accordingly, the dispensing tube 120 of the nozzle assembly 100 dispenses the cleansing water in a state of being slightly inclined toward the front side by the connector 131; an arrival position of the cleansing water is slightly moved to the front side.

In the one pair of front and rear polymer driving bodies 135, when the positive (+) voltage is applied to the rear electrode 137 and the negative (−) voltage is applied to the front electrode (137), the one pair of front and rear polymer driving bodies 135 are inclined to the rear side (in the opposite direction to the arrow in FIG. 10).

Accordingly, in the case that the dispensing tube 120 of the nozzle assembly 10 dispenses cleansing water in a state of being inclined to the rear side, an arrival position of the cleansing water is slightly moved to the rear side.

The case where the dispensing tube 120 is rotated will now be described.

With reference to FIGS. 9 and 10, in the pair of left and right polymer driving bodies 135, a negative (−) voltage is applied to the left electrode 137, and the positive (+) voltage is applied to the right electrode 137. At this time, because the hydrated electroactive polymer of the one pair of left and right polymer driving bodies 135 moves to the left electrode 137 to which the negative (−) voltage is applied, the one pair of left and right polymer driving bodies 135 are bent toward the right electrode 137, forcing the connector 131 to be moved slightly to the right. At this time, the dispensing tube 120 dispenses cleansing water in a state of being slightly inclined to the right (in the direction to the arrow in FIG. 9).

Subsequently, the voltage applied to the electrodes 137 of the one pair of left and right polymer driving bodies 135 is cut off. In the one pair of front and rear polymer driving bodies 135, the negative (−) voltage is applied to the rear electrode 137 and the positive (+) voltage is applied to the front electrode 137. Because moisture contained in the electroactive polymer of the one pair of front and rear polymer driving bodies 135 moves to the rear electrode 137 to which the negative (−) voltage is applied, the one pair of front and rear polymer driving bodies 135 are bent toward the front electrode 137, forcing the connector 131 to be slightly moved to the front side (in the direction to the arrow in FIG. 10).

At this time, because the hydrated electroactive polymer of the one pair of left and right polymer driving bodies 135 has not been recovered to its original state yet, the dispensing tube 120 dispenses cleansing water while being moved to the front side, drawing a conical line in a state of being inclined to the right.

Subsequently, the voltage applied to the electrodes 137 of the one pair of front and rear polymer driving bodies 135 is cut off. In the one pair of left and right polymer driving bodies 135, the positive (+) voltage is applied to the left electrode 137 and the negative (−) voltage is applied to the right electrode 137. At this time, because the hydrated electroactive polymer of the one pair of left and right polymer driving bodies 135 moves to the right electrode 137 to which the negative (−) voltage is applied, the one pair of left and right polymer driving bodies 135 are bent to the left electrode 137, forcing the connector 131 to be slightly moved to the left (in the opposite direction to the arrow in FIG. 9).

At this time, because the hydrated electroactive polymer of the one pair of front and rear polymer driving bodies 135 has not been recovered to its original state yet, the dispensing tube 120 dispenses cleansing water while being moved to the left, drawing a conical line in a state of being inclined to the front side.

Subsequently, the voltage applied to the electrodes 137 of the one pair of front and rear polymer driving bodies 135 is cut off. In the one pair of left and right polymer driving bodies 135, the positive (+) voltage is applied to the rear electrode 137 and the negative (−) voltage is applied to the front electrode 137. At this time, because the hydrated electroactive polymer of the one pair of front and rear polymer driving bodies 135 moves to the front electrode 137 to which the negative (−) voltage is applied, the one pair of left and right polymer driving bodies 135 are bent to the rear electrode 137, forcing the connector 131 to be slightly moved to the rear side (in the opposite direction to the arrow in FIG. 10).

At this time, because the hydrated electroactive polymer of the one pair of front and rear polymer driving bodies 135 has not been recovered to its original state yet, the dispensing tube 120 dispenses cleansing water while being moved to the rear side, drawing a conical line in a state of being inclined to the left.

In this manner, the dispensing tube 120 is rotated while drawing the conical line shape in the state of being inclined at a certain angle, and it can thereby dispense the rotating water stream.

In addition, because the one pair of left and right polymer driving bodies 135 are alternately bent quickly to the left and right, the water stream of the dispensing tube 120 can be vibrated.

A second example of the actuator of the nozzle assembly according to the present invention will now be described.

Figure 11:
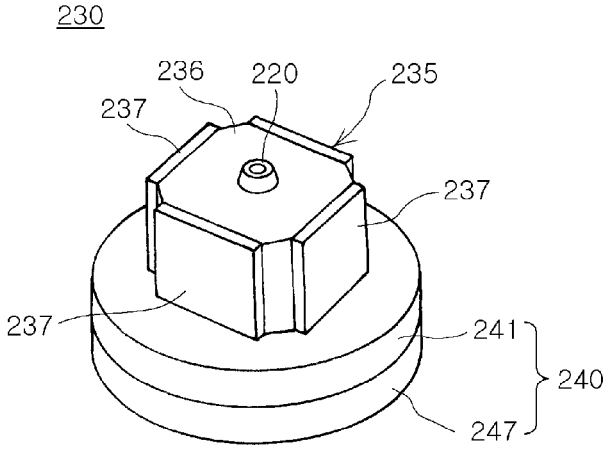
FIG. 11 is a perspective view showing a second example of the actuator according to an exemplary embodiment of the present invention.

FIG. 11 is a perspective view showing a second example of an actuator according to an exemplary embodiment of the present invention.

With reference to FIG. 11, an actuator 230 includes a polymer driving body 235 having a polymer stacked body 236 to which a dispensing tube 220 is coupled, and one or more pairs of electrodes 237 formed on an outer surface of the polymer stacked body 236.

An electroactive polymer is accommodated within the polymer stacked body 236. The electroactive polymer is substantially the same as that of the first example of the actuator, so a detailed description thereof will be omitted.

Each polymer stacked body 236 is formed as a plurality of polymer films **236*a* (See FIG. 12) which are stacked. The electroactive polymer such as the ionic polymer is accommodated within the polymer film 236*a***.

Pairs of electrodes 237 may be disposed in a facing manner on an outer surface of the polymer stacked body 236. In this case, if two pairs of electrodes 237 are disposed on the polymer stacked body 236, one pair of electrodes 237 may be disposed to be parallel to a lengthwise direction of the nozzle body 111, and the other pair of electrodes 237 may be disposed to be perpendicular to the lengthwise direction at both sides of the nozzle body 111.

Voltages of mutually opposite polarities are applied to the one pair of electrodes 237. For example, positive (+) voltage is applied to the left electrode 237, and negative (−) voltage is applied to the right electrode 237.

At this time, because the hydrated electroactive polymer of the one pair of polymer stacked bodies 236 moves to the right electrode 237 to which the negative (−) voltage is applied, the right electrode 237 expands and the left electrode 237 contracts in the one pair of the polymer stacked bodies 236. Accordingly, the one pair of polymer stacked bodies 236 are bent toward the left electrode 237, forcing a dispensing tube 220 to be slightly sloped to the left.

In addition, if two pairs of electrodes 237 are disposed, one pair of electrodes 237 may be disposed such that they are not parallel to the lengthwise direction of the nozzle body 111, while the other pair of electrodes 237 may be disposed such that they are not perpendicular to the lengthwise direction of the nozzle body 111.

In addition, three or more pairs of electrodes 237 may be disposed on the outer surface of the polymer stacked body 236. In this case, the respective pairs of electrodes 237 may be disposed to face each other.

With the polymer driving bodies 235, the dispensing tube 220 may be adjusted to be sloped at a slope angle ranging from 0.5 degrees to 4 degrees. In this case, the slope angle of the dispensing tube 220 may be appropriately adjusted by controlling the size of voltage applied to the polymer driving bodies 235. The adjustment of the slope angle is substantially the same as described above, so a detailed description thereof will be omitted.

The dispensing tube 220 can be rotated by repeatedly applying voltage to the two pairs of electrodes 237 and cutting it off.

A voltage supply unit 240 includes a support ring 241 supporting a lower surface of the polymer stacked body 236, and a PCB 247 applying voltage to the electrode 237 of the polymer driving bodies 235.

A wiring may be printed such that it is connected to the electrodes 237 of the polymer driving bodies 235.

A method for fabricating the second example of the actuator according to an exemplary embodiment of the present invention will now be described.

Figure 12:
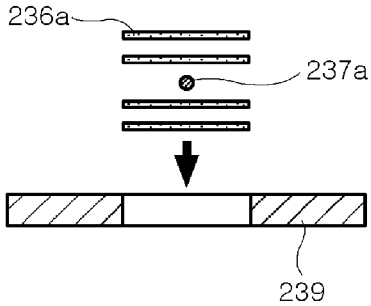
FIGS. 12 and 13 are sectional views illustrating the process of fabricating a polymer driving body of FIG. 11.
Figure 13:
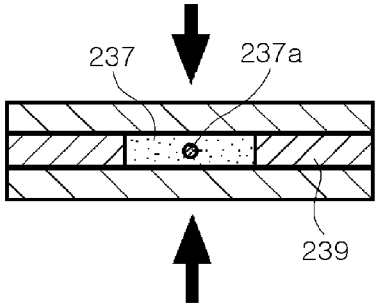

FIGS. 12 and 13 are sectional views illustrating the process of fabricating a polymer driving body.

With reference to FIGS. 12 and 13, a space is formed at an inner side of a mold 239, and a plurality of polymer films 236*a* are stacked in the space of the mold 239. At this time, a steel rod 237*a* is disposed at a central portion of the polymer films 236*a*. Upper and lower sides of the polymer films 236*a* are heated and compressed to fabricate the polymer stacked body 236 having a certain thickness.

After the polymer stacked body 236 is fabricated, the steel rod 237*a* is removed from the polymer stacked body 236. Then, a hole is formed in the polymer stacked body 236, allowing the dispensing tube 220 to be inserted therein A metal layer is deposited on an outer surface of the polymer stacked body 236. As the deposition method of the metal layer, an impregnation chemical reduction called chemical reduction (or electroless plating) is used. Such a chemical reduction is the same as described above, so a detailed description thereof will be omitted.

The metal layer is formed on the entire outer surface of the polymer stacked body 236. Thus, the corners of the polymer stacked body 236 may be cut in order to divide the metal layer into a plurality of electrodes 237.

The operation of the actuator according to an exemplary embodiment of the present invention will now be described.

Figure 14:
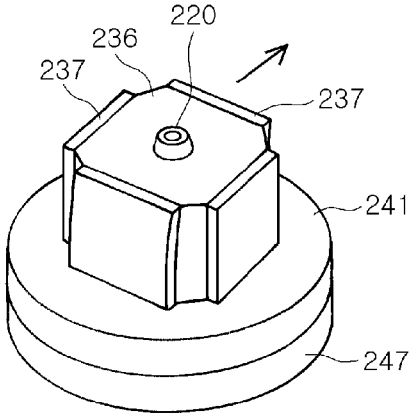
FIG. 14 is a perspective view showing a state that a dispensing tube of FIG. 11 is inclined rightward.
Figure 15:
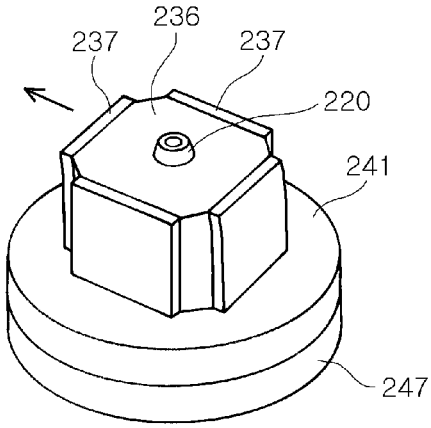
FIG. 15 is a perspective view showing a state that the dispensing tube of FIG. 11 is inclined forward.

In describing the operation of the actuator, it is defined that a right side is in a direction of the arrow in FIG. 14, a left side is in the opposite direction to the arrow in FIG. 14, a front side is in a direction of the arrow in FIG. 15, and a rear side is in the opposite direction to the arrow in FIG. 15.

FIG. 14 is a perspective view showing a state in which the dispensing tube of is inclined rightward.

With reference to FIG. 14, because the polymer driving bodies 235 are at the inner side of the nozzle tip, moisture is continuously supplied to the electroactive polymer of each polymer driving body 235 through the cleansing water flow path 113.

The dispensing tube 220 can be inclined forward/backward or leftward/rightward, or rotated by selectively supplying power to the electrodes 237 of the polymer driving bodies 235. The dispensing tube 220 of the nozzle assembly can be controlled to be inclined or rotated through the manipulating unit.

First, the case in which the dispensing tube 220 is inclined to the left and right side will now be described.

The negative (−) voltage is applied to the left electrode 237, and the positive (+) voltage is applied to the right electrode 237.

At this time, because the hydrated electroactive polymer of the polymer stacked body 236 moves to the left electrode 237 to which the negative (−) voltage is applied, the left electrode 237 expands and the right electrode 237 contracts in the polymer driving bodies 235. Accordingly, the polymer driving bodies 235 are bent toward the right electrode 237, allowing the dispensing tube 220 to be slightly inclined to the right to dispense cleansing water (in the direction of the arrow in FIG. 14).

Also, when the positive (+) voltage is applied to the left electrode 237 and the negative (−) voltage is applied to the right electrode 237, the polymer driving bodies 235 are inclined to the left (in the opposite direction to the arrow in FIG. 14). Accordingly, the dispensing tube 220 dispenses cleaning water in a state of being inclined to the left.

In this manner, when the dispensing tube 220 is moved in the left/right directions, no voltage is applied to the one pair of front and rear electrodes 237.

The case in which the dispensing tube 220 is inclined to the front and rear side will now be described.

FIG. 15 is a perspective view showing a state in which the dispensing tube of FIG. 11 is inclined forward.

With reference to FIG. 15, the negative (−) voltage is applied to the rear electrode 237, and the positive (+) voltage is applied to the front electrode 237. In this case, because the hydrated electroactive polymer of the polymer stacked body 236 moves to the rear electrode 237 to which the negative (−) voltage is applied, the rear electrode 237 expands and the front electrode 237 contracts in the polymer driving bodies 235. Accordingly, the polymer driving bodies 235 are bent toward the front electrode 237, allowing the dispensing tube 220 to be slightly inclined to the front side to dispense cleansing water (in the direction of the arrow in FIG. 15).

Also, when the positive (+) voltage is applied to the rear electrode 237 and the negative (−) voltage is applied to the front electrode 237, the polymer driving bodies 235 are inclined to the rear side (in the opposite direction of FIG. 15). Accordingly, the dispensing tube 220 dispenses cleaning water in a state of being slightly inclined to the rear side.

The case where the dispensing tube is rotated will now be described.

The negative (−) voltage is applied to the left electrode 237 and the positive (+) voltage is applied to the right electrode 237. At this time, because hydrated electroactive polymer of the polymer stacked body 236 moves to the left electrode 237 to which the negative (−) voltage is applied, the polymer stacked body 236 are bent toward the right electrode 237, allowing the dispensing tube 220 to be slightly inclined to the right to dispense cleansing water (the direction of the arrow in FIG. 14).

Subsequently, the voltage applied to the one pair of left and right electrodes 237 is cut off. The negative (−) voltage is applied to the rear electrode 237 and the positive (+) voltage is applied to the front electrode 237. Then, because the hydrated electroactive polymer of the polymer stacked body 236 moves to the rear electrode 237 to which the negative (−) voltage is applied, the polymer stacked bodies 236 are bent toward the front electrode 237 (in the direction of the arrow in FIG. 15).

At this time, because the hydrated electroactive polymer of the polymer stacked body 236 has not been recovered to its original state yet, the dispensing tube 220 dispenses cleansing water while being moved to the front side, drawing a conical line in a state of being inclined to the right.

Subsequently, the voltage applied to the one pair of front and rear electrodes 237 is cut off. And, the positive (+) voltage is applied to the left electrode 237 and the negative (−) voltage is applied to the right electrode 237. Then, because hydrated electroactive polymer of the polymer driving bodies 235 moves to the right electrode 237 to which the negative (−)

voltage is applied, the polymer stacked bodies 236 are bent toward the left electrode 237 (in the opposite direction of the arrow in FIG. 14).

At this time, because the hydrated electroactive polymer of the polymer driving bodies 235 has not been recovered to its original state yet, the dispensing tube 220 dispenses cleansing water while being moved to the left, drawing a conical line in a state of being inclined to the front side.

Subsequently, the voltage applied to the one pair of front and rear electrodes 237 is cut off. The positive (+) voltage is applied to the rear electrode 237 and the negative (−) voltage is applied to the front electrode 237. Then, because the hydrated electroactive polymer of the polymer stacked body 236 moves to the front electrode 237 to which the negative (−) voltage is applied, the polymer driving bodies 235 are bent toward the rear electrode 237 (in the opposite direction of the arrow in FIG. 15).

At this time, because the hydrated electroactive polymer of the polymer stacked body 236 has not been recovered to its original state yet, the dispensing tube 220 dispenses cleansing water while being moved to the rear side, drawing a conical line in a state of being inclined to the left.

In this manner, the dispensing tube 220 is rotated while drawing the conical line in the state of being inclined at a certain angle, so the rotating water stream can be dispensed.

In addition, because the polymer driving bodies 235 are alternately bent quickly to the left and right, the water stream of the dispensing tube 220 can be vibrated.

INDUSTRIAL APPLICABILITY

According to an aspect of the present invention, the dispensing direction and dispensing angle of the cleansing nozzle can be variably controlled.

The invention claimed is:

1. A nozzle assembly of a toilet bidet comprising:

a cleansing nozzle with a cleansing water flow path;

a dispensing tube connected with the cleansing water flow path to dispense cleansing water;

an actuator including a connector coupled to the dispensing tube and a plurality of polymer driving bodies coupled to the connector, wherein an electroactive polymer is housed within the polymer driving bodies, and a pair of electrodes are formed on an outer surface of the polymer driving bodies; and a voltage supply unit that applies voltage to the electrodes of the polymer driving bodies, wherein, when the voltage is applied to the electrodes of each polymer driving body, the electroactive polymer moves toward one electrode to force a corresponding polymer driving body to be bent to thereby adjust a dispensing angle of the dispensing tube.

2. The nozzle assembly of claim 1, wherein the plurality of polymer driving bodies are disposed relative to one another such that pairs of the polymer driving bodies face each other centered on the dispensing tube.

3. The nozzle assembly of claim 2, wherein two pairs of polymer driving bodies are disposed, of which one pair is disposed along a lengthwise direction of the nozzle body and the other pair is disposed at both sides of the nozzle body in the lengthwise direction.

4. The nozzle assembly of claim 3, wherein a same polarity of voltage is applied to the electrodes in a same direction in each of the pairs of polymer driving bodies.

5. The nozzle assembly of claim 1, wherein a plurality of insertion portions are formed at the connector to allow an end portion of each polymer driving body to be inserted therein.

6. The nozzle assembly of claim 5, wherein each insertion portion forms a gap with a corresponding polymer driving body in a direction perpendicular to a strain direction of the corresponding polymer driving body.

7. The nozzle assembly of claim 1, wherein the voltage supply unit comprises:

an inner ring having a plurality of recesses on its external surface;

an outer ring having an inner side to which the inner ring is inserted and having a plurality of recesses corresponding to the plurality of recesses of the inner ring to allow each polymer driving body to be inserted therein; and a printed circuit board that applies the voltage to the electrode of each polymer driving body.

8. The nozzle assembly of claim 7, wherein an electricity connection unit is formed to correspond to the electrodes of each polymer driving body at the recesses of the inner ring and the outer ring.

9. The nozzle assembly of claim 1, wherein the dispensing tube is adjusted at a slope angle ranging from 0.5 degrees to 4 degrees.

10. A nozzle assembly of a toilet bidet comprising:

a cleansing nozzle with a cleansing water flow path;

a dispensing tube connected with the cleansing water flow path to dispense cleansing water;

an actuator including a polymer stacked body to which a dispensing tube is coupled, and a pair or more electrodes formed on an outer surface of the polymer stacked body; and a voltage supply unit that applies voltage to the electrodes, wherein, when the voltage is applied to the electrodes, electroactive polymer is moved toward one electrode to force the polymer stacked body to be bent to thus adjust a dispensing angle of the dispensing tube.

11. The nozzle assembly of claim 10, wherein the respective pairs of electrodes are disposed to face each other based on the dispensing tube.

12. The nozzle assembly of claim 11, wherein two pairs of electrodes are disposed on the outer surface of the polymer stacked body, of which one pair of electrodes is disposed along a lengthwise direction of the nozzle body, and the other pair of electrodes is disposed at both sides of the nozzle body in the lengthwise direction.

13. The nozzle assembly of claim 12, wherein the voltage supply unit comprises a printed circuit board applying the voltage to each electrode.

14. The nozzle assembly of claim 10, wherein a slope angle of the dispensing tube is adjusted within the range of 0.5 degrees to 4 degrees.

15. A method for controlling a nozzle assembly of a toilet bidet, the method comprising:

adjusting a dispensing angle of a dispensing tube by applying voltage to an electrode of a pair of facing polymer driving bodies among a plurality of polymer driving bodies.

16. A method for controlling a nozzle assembly of a toilet bidet, the method comprising:

adjusting a dispensing angle of a dispensing tube by applying voltage to a pair of facing electrodes of a polymer stacked body.

17. A method for controlling a nozzle assembly of a toilet bidet, the method comprising:

repeatedly applying voltage to electrodes of polymer driving bodies and cutting the voltage off, to continuously change a dispensing angle of a dispensing tube to thus allow a water stream to be dispensed while being vibrated or rotated.

18. The method of claim 17, wherein immediately when the voltage applied to the pair of electrodes is cut off, the voltage is applied to another pair of electrodes.

* * * * *